US005300238A

United States Patent [19]

Lin et al.

[11] Patent Number: 5,300,238

[45] Date of Patent: * Apr. 5, 1994

[54] DRYER SHEET FABRIC CONDITIONER CONTAINING FABRIC SOFTENER, AMINOSILICONE AND BRONSTED ACID COMPATIBILIZER

[75] Inventors: Samuel Lin, Paramus; Timothy Taylor, Hoboken, both of N.J.

[73] Assignee: Lever Brothers Company, Division of Conopco, Inc., New York, N.Y.

[ * ] Notice: The portion of the term of this patent subsequent to Nov. 12, 2008 has been disclaimed.

[21] Appl. No.: 776,719

[22] Filed: Oct. 15, 1991

Related U.S. Application Data

[63] Continuation of Ser. No. 532,473, Jun. 1, 1990, abandoned.

[51] Int. Cl.[5] ..... D06M 10/08

[52] U.S. Cl. ..... 252/8.6; 252/8.8; 252/8.9; 252/174.15

[58] Field of Search ..... 252/8.6, 8.7, 8.8, 8.9, 252/174.15

[56] References Cited

U.S. PATENT DOCUMENTS

| | | | |
|---|---|---|---|
| 3,402,191 | 9/1968 | Morehouse | 570/126 |
| 3,655,420 | 4/1972 | Tichenor | 252/8.6 |
| 3,972,131 | 8/1976 | Rudy et al. | 34/60 |
| 4,137,180 | 1/1979 | Naik et al. | 252/8.8 |
| 4,308,024 | 12/1981 | Wells | 8/137 |
| 4,386,000 | 5/1983 | Turner et al. | 252/8.8 |
| 4,446,033 | 5/1984 | Barrat et al. | 252/8.6 |
| 4,639,321 | 1/1987 | Barrat et al. | 25/8.8 |
| 4,661,267 | 4/1987 | Dekker et al. | 252/8.8 |
| 4,661,269 | 4/1987 | Trinh et al. | 252/8.8 |
| 4,724,089 | 2/1988 | Konig et al. | 252/8.8 |
| 4,757,121 | 7/1988 | Tanaka et al. | 528/27 |
| 4,767,547 | 8/1988 | Straathof et al. | 252/8.8 |
| 4,767,548 | 8/1988 | Kasprzak et al. | 252/8.8 |
| 4,769,159 | 9/1988 | Copeland | 252/8.8 |
| 4,789,491 | 12/1988 | Chang et al. | 252/8.75 |
| 4,800,026 | 1/1989 | Coffindaffer et al. | 252/8.8 |
| 4,806,255 | 2/1989 | König et al. | 252/8.8 |
| 4,810,253 | 3/1989 | Kasprzak et al. | 8/137 |
| 4,818,242 | 4/1989 | Burmeister et al. | 8/115.6 |
| 4,834,895 | 5/1989 | Cook et al. | 252/8.6 |
| 4,933,097 | 6/1990 | Keegan | 252/8.8 |
| 5,064,544 | 11/1991 | Lin et al. | 252/8.6 |
| 5,174,911 | 12/1992 | Lin et al. | 252/8.6 |
| 5,238,587 | 8/1993 | Smith et al. | 252/8.6 |

FOREIGN PATENT DOCUMENTS

| | | |
|---|---|---|
| 0255711 | 2/1988 | European Pat. Off. . |
| 49-36726 | 5/1984 | Japan . |
| 62-78277 | 4/1987 | Japan . |
| 1549180 | 7/1979 | United Kingdom . |
| 2172910 | 10/1986 | United Kingdom . |

OTHER PUBLICATIONS

CRC Handbook fo Chemistry and Physics; 1989-1990, 70th Edition; pp. C-306, C-396, and C-495, no month available.

*Primary Examiner*—Linda Skaling
*Assistant Examiner*—Michael P. Tierney
*Attorney, Agent, or Firm*—Rimma Mitelman

[57] ABSTRACT

Fabric conditioning compositions for coating a flexible substrate for subsequent use in a mechanical tumble dryer are disclosed. The compositions incorporate compatible mixtures of common fabric softening agents, aminosilicones and Bronsted acids having at least 6 carbon atoms.

12 Claims, No Drawings

DRYER SHEET FABRIC CONDITIONER CONTAINING FABRIC SOFTENER, AMINOSILICONE AND BRONSTED ACID COMPATIBILIZER

This is a continuation application of Ser. No. 07/532,473, filed Jun. 1, 1990, now abandoned.

BACKGROUND OF THE INVENTION

1. Field of the Invention

The instant invention relates to application of adjuvants to fabrics in tumble-dryer automatic dryers. More particularly, it relates to an article in the form of a flexible substrate carrying a fabric conditioning composition.

2. Related Art

Silicones have been applied to fabrics during manufacture of fabrics or during the make up of articles of clothing using processes such as padding or spraying. With respect to application of silicones to fabrics during a laundry process, Great Britain Patent Application No. 1,549,180; Burmeister et al., U.S. Pat. No. 4,818,242; Konig et al., U.S. Pat. No. 4,724,089; Konig et al., U.S. Pat. No. 4,806,255; Dekker et al., U.S. Pat. No. 4,661,267 and Trinh et al., U.S. Pat. No. 4,661,269 describe aqueous dispersions or emulsions of certain silicones of limited viscosity incorporated in liquid rinse-cycle fabric softening compositions. The disclosed compositions are rinse-cycle aqueous dispersions. A fabric softening composition containing emulsified silicone combined with conventional cationic softening agent is also taught by Barrat et al. in U.S. Pat. No. 4,446,033. The compositions are taught for use during the aqueous rinse cycle of a laundry process. The rinse compositions taught by the '089, '255, '267 and '269 patents contain cyclic amine fabric softening agents and employ water-soluble Bronsted acids to control the pH of the aqueous compositions for proper dispersion of the amine.

The compositions disclosed in the art contain individual particles of a silicone and individual particles of a fabric softening agent.

Wells, U.S. Pat. No. 4,308,024 discloses non-silicone fabric softening compositions consisting essentially of a water-insoluble cationic detergent surfactant and a $C_8$–$C_{24}$ alkyl-or alkenyl monocarboxylic acid.

The application of fabric softeners to fabrics in the tumble dryer by use of a flexible substrate carrying the fabric softeners is known in the art. The advantages of dryer added fabric conditioning include a more convenient time of addition in the laundry process and avoidance of undesirable interaction of softening agents with detergents.

Rudy et al., U.S. Pat. No. 3,972,131 discloses dryer sheets including a silicone oil as an ironing aid. Kasprzak et al., U.S. Pat. No. 4,767,548 discloses the use of certain silicones in dryer sheet formulations.

Coffindaffer et al., U.S. Pat. No. 4,800,026 discloses curable amine functional silicones in fabric care compositions.

Japanese Patent 62/78,277 discloses chemically combined condensation products of amino modified silicone oil as softeners.

In the manufacture of the dryer added fabric conditioning sheets described in the references mentioned above, when silicones are mixed with fabric softeners, the resulting mixtures are non-homogeneous and phase separation occurs readily. The homogeneity of such mixtures is ensured only by continuous vigorous agitation. An additional problem associated with the use of a nonhomogeneous mixture is the separation of actives at the point of application of the active mixture on the substrate resulting in unevenly impregnated sheets.

Bronsted acids described herein compatibilize aminosilicones with fabric softening agents. Critically, the aminosilicones in the compatible mixtures of the present invention do not separate from the fabric softening agent during coating or solidifying of the dryer sheets. Thus, the present invention affords easier processing of dryer added fabric conditioning sheets. Additionally, even and uniform distribution of the actives on the dryer sheet can be attained, alleviating the problem of unevenly impregnated sheets.

Accordingly, it is an object of the present invention to provide an article which provides for release of a fabric conditioning composition within an automatic laundry dryer, the composition containing a compatible mixture of a fabric softening component, an aminosilicone and a Bronsted acid.

These and other objects and advantages will appear as the description proceeds.

SUMMARY OF THE INVENTION

The present invention is based, in part, on the discovery that specific Bronsted acids are capable of compatibilizing aminosilicones with certain conventional fabric softening agents. As a result of the use of Bronsted acids as described herein compatible mixtures containing an aminosilicone and a fabric softening component can be formed.

It is important to differentiate between compatible and incompatible mixtures. Compatibility as taught herein is critical and is ascertained by the appearance and behavior of the mixture containing an aminosilicone, a fabric softener and a Bronsted acid. When an aminosilicone, a fabric softener and a Bronsted acid are heated and mixed together, the resulting mixtures are either clear or cloudy. In the clear mixtures, the aminosilicone, the fabric softener and the Bronsted acid are mutually soluble and the clear mixtures are compatible. In the cloudy mixtures, the aminosilicone, the fabric softener and the Bronsted acid may or may not form mutually stable dispersions. A mutually stable dispersion is also compatible and is formed if a mixture of the aminosilicone, the fabric softener and the Bronsted acid does not separate into more than one phase on storage at elevated temperatures and if the mixture does form a uniform liquid or solid on cooling. Thus, the class of compatible mixtures as defined herein includes mutually soluble mixtures of an aminosilicone, a fabric softener and a Bronsted acid as well as mixtures wherein an aminosilicone, a fabric softener and a Bronsted acid form mutually stable dispersions. Compatibility of the mixture is critical and is determined by the Compatibility Test described below.

In its broadest aspect, the objects of the invention are accomplished by an article comprising a flexible substrate carrying an effective amount of a fabric conditioning composition affixed thereto in a manner which provides for release of the conditioning composition within an automatic tumble dryer at dryer operating temperatures.

The fabric conditioning composition employed in the present invention contains conventionally used cationic and nonionic fabric softening agents, such as (i) cationic quaternary ammonium salts;

(ii) nonionic softeners selected from the group of tertiary amines having at least one $C_{8-30}$ alkyl chain, esters of polyhydric alcohols, fatty alcohols, ethoxylated fatty alcohols, alkylphenols, ethoxylated alkylphenols, ethoxylated fatty amines, ethoxylated monoglycerides, ethoxylated diglycerides, mineral oils, polyols, and mixtures thereof;

(iii) carboxylic acids having at least 8 carbon atoms; and (iv) mixtures thereof.

The fabric conditioning compositions of the present invention include an organosilicone having an amine functionality, i.e. an aminosilicone.

The compositions also contain Bronsted acids which compatibilize an aminosilicone with a fabric softening component. Bronsted acids employed in the present invention have at least 6 carbon atoms. The weight ratio of the Bronsted acid to the combined weight of the aminosilicone and the fabric softening component is at least such that a compatible mixture of the fabric softening component, the aminosilicone and the Bronsted acid is formed, as determined by the Compatibility Test.

Each component of the present compositions: the fabric softening component, the aminosilicone and the Bronsted acid may provide fabric conditioning benefits including softness, fluffiness, static control, and other benefits when fabrics are commingled with compositions of the invention in a tumble dryer.

DETAILED DESCRIPTION OF THE INVENTION

An article is disclosed for conditioning fabrics in a tumble dryer. The article of the invention comprises a flexible substrate which carries a fabric conditioning amount of a conditioning composition and is capable of releasing the conditioning composition at dryer operating temperatures. The conditioning composition in turn has a preferred melting (or softening) point of about 25° C. to about 150° C.

The fabric conditioning composition employed in the invention is coated onto a dispensing means which effectively releases the fabric conditioning composition in a tumble dryer. Such dispensing means can be designed for single usage or for multiple uses. One such article comprises a sponge material releasably enclosing enough of the conditioning composition to effectively impart fabric softness during several drying cycles. This multi-use article can be made by filling a porous sponge with the composition. In use, the composition melts and leaches out through the pores of the sponge to soften and condition fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the composition and sealed with a hardened plug of the mixture. The action and heat of the dryer opens the bag and releases the composition to perform its softening.

A highly preferred article comprises the compositions containing the softener and the compatible silicone releasably affixed to a flexible substrate such as a sheet of paper or woven or nonwoven cloth substrate. When such an article is placed in an automatic laundry dryer, the heat, moisture, distribution forces and tumbling action of the dryer removes the composition from the substrate and deposits it on the fabrics.

The sheet conformation has several advantages. For example, effective amounts of the compositions for use in conventional dryers can be easily absorbed onto and into the sheet substrate by a simple dipping or padding process. Thus, the end user need not measure the amount of the composition necessary to obtain fabric softness and other benefits. Additionally, the flat configuration of the sheet provides a large surface area which results in efficient release and distribution of the materials onto fabrics by the tumbling action of the dryer.

The substrates used in the articles can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

It is known that most substances are able to absorb a liquid substance to some degree; however, the term "absorbent", as used herein, is intended to mean a substrate with an absorbent capacity (i.e., a parameter representing a substrate's ability to take up and retain a liquid) from 4 to 12, preferably 5 to 7 times its weight of water.

If the substrate is a foamed plastics material, the absorbent capacity is preferably in the range of 15 to 22, but some special foams can have an absorbent capacity in the range from 4 to 12.

Determination of absorbent capacity values is made by using the capacity testing procedures described in U.S. Federal Specifications (UU-T-595b), modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., Kraft or bond having a basis weight of about 32 pounds per 3,000 square feet) has an absorbent capacity of 3.5 to 4; commercially available household one-ply toweling paper has a value of 5 to 6; and commercially available two-ply household toweling paper has a value of 7 to about 9.5.

Suitable materials which can be used as a substrate in the invention herein include, among others, sponges, paper, and woven and non-woven cloth, all having the necessary absorbency requirements defined above.

The preferred non-woven cloth substrates can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e. an array of fibers in a carded web wherein partial orientation of the fibers is frequently present, as well as a completely haphazard distributional orientation), or substantially aligned. The fibers or filaments can be natural (e.g. wool, silk, jute, hemp, cotton, linen, sisal, or ramie) or synthetic (e.g. rayon, cellulose ester, polyvinyl derivatives, polyolefins, polyamides, or polyesters).

The preferred absorbent properties are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a composition by means of intersectional or capillary action. Thus, any thickness necessary to obtain the required absorbent capacity can be used.

When the substrate for the composition is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant. Preferably, the fibers are from 5mm to 50mm in length and are from 1.5 to 5 denier. Preferably, the fibers are at least partially oriented haphazardly, and are adhesively bonded together with a hydrophobic or substantially hydrophobic binder-resin. Preferably, the cloth comprises about 70% fiber and 30% binder resin polymer by weight and has a basis weight of from about 18 to 45 g per square meter.

In applying the fabric conditioning composition to the absorbent substrate, the amount impregnated into and/or coated onto the absorbent substrate is conveniently in the weight ratio range of from about 10:1 to 0.5:1 based on the ratio of total conditioning composition to dry, untreated substrate (fiber plus binder). Preferably, the amount of the conditioning composition ranges from about 5:1 to about 1:1, most preferably from about 3:1 to 1:1, by weight of the dry, untreated substrate.

According to one preferred embodiment of the invention, the dryer sheet substrate is coated by being passed over a rotogravure applicator roll. In its passage over this roll, the sheet is coated with a thin, uniform layer of molten fabric softening composition contained in a rectangular pan at a level of about 15 g/square yard. Passage of the substrate over a cooling roll then solidifies the molten softening composition to a solid. This type of applicator is used to obtain a uniform homogeneous coating across the sheet.

Following application of the liquefied composition, the articles are held at room temperature until the composition substantially solidifies. The resulting dry articles, prepared at the composition substrate ratios set forth above, remain flexible; the sheet articles are suitable for packaging in rolls. The sheet articles can optionally be slitted or punched to provide a non-blocking aspect at any convenient time if desired during the manufacturing process.

The fabric conditioning composition employed in the present invention includes certain fabric softeners which can be used singly or in admixture with each other.

FABRIC SOFTENER COMPONENT

Fabric softeners suitable for use herein are selected from the following classes of compounds:

(i) Cationic quaternary ammonium salts. The counterion is methyl sulfate or any halide, methyl sulfate being preferred for the drier-added articles of the invention. Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium methylsulfate, di(hydrogenated tallow)dimethyl ammonium methylsulfate, distearyldimethyl ammonium methylsulfate, dicocodimethyl ammonium methylsulfate and the like;

(2) Cyclic quaternary ammonium salts of the imidazolinium type such as di(hydrogenated tallow)-dimethyl imidazolinium methylsulfate, 1-ethylene-bis(2-tallow-1-methyl) imidazolinium methylsulfate and the like;

(3) Diamido quaternary ammonium salts such as: methyl-bis(hydrogenated tallow amidoethyl)-2-hydroxyethyl ammonium methyl sulfate, methyl bis(tallowamidoethyl)-2-hydroxypropyl ammonium methylsulfate and the like;

(4) Biodegradable quaternary ammonium salts such as N,N-di(tallowoyl-oxy-ethyl)-N,N,-dimethyl ammonium methyl sulfate and N,N-di(tallowoyl-oxy-propyl)-N,N-dimethyl ammonium methyl sulfate. When fabric conditioning compositions employ biodegradable quaternary ammonium salts, pH of the composition is preferably adjusted to between about 2 and about 5. Biodegradable quaternary ammonium salts are described, for example, in U.S. Pat. Nos. 4,137,180, 4,767,547 and 4,789,491 incorporated by reference herein.

(ii) Tertiary fatty amines having at least one and preferably two C8 to C30, preferably C12 to C22 alkyl chains. Examples include hardened tallow amine and cyclic amines such as 1-(hydrogenated tallow)amidoethyl-2-(hydrogenated tallow) imidazoline. Cyclic amines which may be employed for the compositions herein are described in U.S. Pat. No. 4,806,255 incorporated by reference herein.

(iii) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and the like which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(v) Fatty alcohols, ethoxylated fatty alcohols, alkylphenols, ethoxylated alkylphenols, ethoxylated fatty amines, ethoxylated monoglycerides and ethoxylated diglycerides.

(vi) Mineral oils, and polyols such as polyethylene glycol.

These softeners are more definitively described in U.S. Pat. No. 4,134,838 the disclosure of which is incorporated by reference herein. Preferred fabric softeners for use herein are acyclic quaternary ammonium salts, di(hydrogenated)tallowdimethyl ammonium methylsulfate is most preferred for dryer articles of this invention.

The amount of the fabric softening composition on the sheet is subject to normal coating parameters such as, for example, viscosity and melting point of the fabric softening component and is typically about 0.5 grams to about 5 grams, preferably about 1 gram to about 3.5 grams. The fabric softening composition employed in the present invention contains about 0.1% to about 95% of the fabric softening component. Preferably from about 10% to about 80% and most preferably from about 30% to about 70% of the fabric softening component is employed herein to obtain optimum softening at minimum cost. When the fabric softening component includes a quaternary ammonium salt, the salt is used in the amount of about 10% to about 80%, preferably about 30% to about 70%.

AMINOSILICONE

The second essential ingredient of the fabric softening composition employed in the present invention is an aminosilicone. Any organosilicone having an amine functionality is suitable for use herein. Particularly suitable aminosilicones are represented by Formula A:

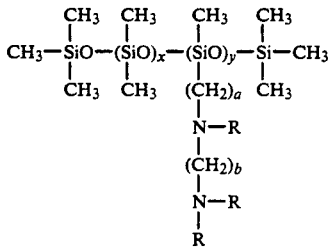

FORMULA A wherein x and y are numbers of at least 1; a and b are numbers from 1 to 10,preferably from 1 to 5; and R is hydrogen or a hydrocarbon radical, preferably hydrogen. Preferably x is a number from 4 to 1000, most preferably from 50 to 1000, and the ratio of $y/(x+y)$ is from 0.1% to 30%, most preferably from 1% to 10%.

Typically, aminosilicones having higher amine content exhibit greater compatibility in the mixtures containing an aminosilicone, a Bronsted acid and a fabric softener.

The following list is illustrative of the aminosilicones employed in this invention:

| Name | Amine Neutral Milliequivalent/ gram of silicone | Viscosity (cst) |
|---|---|---|
| Magnasoft Fluid[1] | 0.5 | 250 |
| Magnasoft Ultra[1] | 0.5 | 950 |
| SSF[2] | 0.5 | 130 |
| CSF[2] | 0.5 | 1300 |
| Silicne SL | 1.26 | 350 |
| F-641[3] | 0.07 | 6000 |
| F-751[3] | 0.14 | 500 |
| F-784[3] | 0.45 | 50 |
| F-808[3] | 1.6 | 20 |

[1]Aminosilicone from Union Carbide Corp.
[2]Aminosilicone from Dow Corning Corp.
[3]Aminosilicone from Wacker Silicones In Silicone SL, x=200, y=10, R=hydrogen, a=3 and b=2. Silicone SL is most preferred under current empirical conditions.

Of course, other aminosilicones may be employed.

The aminosilicones included in the compositions herein may be linear, branched, or partially crosslinked, preferably linear, and may range from fluid, liquid to viscous liquid, gum and solid. The aminosilicones preferably have viscosities between about 75 and 3000 cst.

The amount of an aminosilicone employed herein typically is about 0.1% to about 20%, and is preferably at least about 3% to achieve fabric conditioning benefit at an optimum cost.

BRONSTED ACID

Bronsted acids suitable for use in the present invention contain an alkyl group having at least 6 carbon atoms, preferably 12 to 24 carbon atoms and most preferably 16 to 20 carbon atoms. The alkyl group may be selected from the group of linear or branched alkyl, linear or branched alkenyl, linear or branched alkylaryl or alkenylaryl, linear or branched ethoxylated alcohols, or other alkyl groups. The acid groups combined with the above alkyl groups to give suitable Bronsted acids for the present invention include carboxylic, sulfuric, sulfonic, phosphonic, phosphinic, phosphoric and di-alkyl-sulfosuccinic acids. Bronsted acids employed in the present invention have 1 to 3 acid groups, and preferably have 1 acid group. If the Bronsted acid contains 2 or 3 acid groups per molecule, it is preferred that the acid groups are located structurally close to each other, such as in germinal di-acids or on adjacent carbons. Bronsted acids employed in the present invention may also be substituted with electron-withdrawing groups such as, for example, a hydroxy group. Examples of Bronsted acids suitable for the present invention include but are not limited to:

(i) $C_{17}H_{35}COOH$ or other fatty acids;

(ii) $C_{11}H_{23}—C_6H_4—SO_3H$ or other alkylaryl sulfonic acids;

(iii) $C_{14}H_{29}—O—(C_2H_4O)n—R^1—COOH$ (wherein n is a number from 1 to 25 and $R^1$ is an alkyl group having 1 to 3 carbon atoms);

(iv) $(R^2)_2$

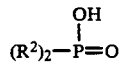

(wherein $R^2$ is an alkyl, alkenyl, alkylaryl, alkenylaryl or other alkyl group) or other phosphonic acids;

(v) $CH_3—(CH_2)_m—PO_3H_2$ (wherein m is a number of at least 1) and $CH_3—(CH_2)—O—PO_3H_2$;

(vi)

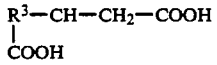

(wherein $R^3$ is an alkyl, alkenyl, alkyaryl, alkenylargyl, or other alkyl group).

(vii)

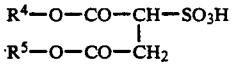

(wherein $R^4$ and $R^5$ can be the same or different and can be alkyl, alkenyl, or alkylaryl and may be linear or branched). Preferably both $R^4$ and $R^5$ are the same linear alkyl having 6 to 22, most preferably 8 to 18 carbon atoms. Mutual compatibility of the fabric softening component and the aminosilicone is achieved by addition of a certain amount Bronsted acid.

The weight ratio of the Bronsted acid to the combined weight of the fabric softening component and the aminosilicone is from about 1:100 to about 100:1 but must be at least such that the compatibility among the fabric softening component, the aminosilicone and the Bronsted acid is ensured. The compatibility among the components of the mixture is critical and is ascertained by the Compatibility Test.

AMINOSILICONE/SOFTENER/BRONSTED ACID COMPATIBILITY TEST

As described above, mixtures defined as compatible herein include mutually soluble as well as mutually stable dispersible mixtures. The Compatibility Test is employed to determine whether the particular amount of Bronsted acid compatibilizes an aminosilicone with a fabric softening component.

The Compatibility Test is conducted as follows: a 10 gram sample containing a fabric softening component and an aminosilicone is placed into a clear glass flask equipped with a stirring mechanism, such as a magnetic stirrer. A Bronsted acid in the amount of interest is slowly introduced with, conveniently, a Pasteur pipet into the flask, with stirring. If a fabric softening component or an aminosilicone or a Bronsted acid is a solid at room temperature, it is melted before the test is begun with the test taking place above the melting point of the fabric softener or the aminosilicone or the Bronsted acid. Thus, compatibility is defined herein with respect to liquid or liquefied mixtures containing the aminosilicone, the fabric softening component and the Bronsted acid.

If the resulting mixture containing the fabric softening component, the aminosilicone and the Bronsted acid is clear, this indicates that the components of the mixture are mutually soluble and, accordingly, are compatible. Clear mixtures are defined herein as mixtures having about 90% transmittance when measured with visible light probe (one centimeter pathlegth) against distilled water background using Brinkman PC800 colorimeter.

The mixture may also become cloudy, indicating that the fabric softening component, the aminosilicone and the Bronsted acid are not mutually soluble at that weight % of the Bronsted acid.

Cloudy samples are placed in an oven at 100° C. for at least two hours, then cooled to room temperature and inspected. Samples which have completely separated into distinct layers are incompatible and are not useful for the invention. Samples which maintain a stable, dispersed or soluble character are compatible and, hence, useful in the invention. If compatible mixtures solidify on cooling, they may become cloudy, but they remain homogeneous.

Preferably, the components of the mixture containing the fabric softener, the aminosilicone and the Bronsted acid are compatible at a silicone concentration of at least about 2%.

Mutually soluble and clear mixtures of the silicone, the fabric softening component and the Bronsted acid indicate the highest degree of compatibility and are preferred. Mutual solubility of the fabric softening component and the aminosilicone is achieved by addition of Bronsted acid.

The amount of the Bronsted acid necessary to compatibilize the aminosilicone with the fabric softening component depends on the particular fabric softening component, the aminosilicone and the amounts of the fabric softening component and the aminosilicone used. The appropriate amount of the Bronsted acid is ascertained by the Compatibility Test.

The amount of Bronsted acid needed to compatibilize an aminosilicone with a fabric softening component may be approximated using a calculation based on amine neutral equivalent of the aminosilicone. Amine neutral equivalent (also known as base equivalent) of the aminosilicone is usually indicated on Material Safety Data Sheets obtained from the supplier. Using, for example, DC X2-8122 (an aminosilicone having $1.26\times10^{-3}$ equivalents per gram) and stearic acid (having $3.5\times10^{-3}$ equivalents per gram) the ratio of the aminosilicone to stearic acid is as follows:

$3.51\times10^{-3}$ eq stearic acid/gram stearic acid $1.26\times10^{-3}$ eq aminosilicone/gram aminosilicone and is equal to 2.79 grams aminosilicone per gram stearic acid. Preferably, a small excess of the Bronsted acid is used.

However, it should be understood that the above calculation based on amine neutral equivalent of the aminosilicone may be used only as a guideline and the mutual compatibility among an aminosilicone, a fabric softener and a Bronsted acid should be ascertained by conducting the Compatibility Test. For example, mutual compatibility among the aminosilicone, the fabric softening component and the Bronsted acid also depends on the particular fabric softening component. Where the fabric softening component itself contains a carboxylic acid the amount of the Bronsted acid necessary to form the mutually soluble mixture may be less than the amount obtained from the above calculation.

Various additives may be used in combination with the compatible mixture of the fabric softening component, the compatible silicone. The additives are used in the amounts that do not substantially affect the compatibility of the mixture and include small amounts of incompatible silicones, such as predominantly linear polydialkylsiloxanes, e.g. polydimethylsiloxanes; soil release polymers such as block copolymers of polyethylene oxide and terephthalic acid; amphoteric surfactants; anionic soaps; and zwitterionic quaternary ammonium compounds. Smectite type inorganic clays improve the processing of the compositions and do not settle out and, hence, do not adversely affect the homogeneity of the compatible mixtures and may be used in the amounts of up to about 10%.

Other optional ingredients include optical brighteners or fluorescent agents, perfumes, colorants, germicides and bactericides.

The aminosilicone, the fabric softening component and the Bronsted acid which have been determined by the Compatibility Test to form a compatible mixture are heated and mixed, and the resulting fabric conditioning mixture is coated onto a flexible substrate.

The following Examples will more fully illustrate the embodiments of this invention. All parts, percentages and proportions referred to herein and in the appended claims are by weight unless otherwise indicated.

EXAMPLE I

Compatibilizing effect of Bronsted acids in fabric softening mixtures containing an aminosilicone and mineral oil was studied. Results that were generated are summarized in Table I.

TABLE I

| Components | Weight (grams) Sample IA | IB | IC | ID |
|---|---|---|---|---|
| Mineral oil[1] | 10 | 5.0 | 50 | 50 |
| Aminosilicone[2] | 0.2 | 4.40 | 100 | 100 |
| Hexanoic Acid[3] | — | 0.61 | — | — |
| Hydrochloric Acid | — | — | 4.6 | — |
| Acetic Acid | — | — | — | 7.58 |

[1]Fisher Light Mineral Oil
[2]Silicone SL
[3]Aldrich Gold Label

Sample IA was observed to be opaque at the aminosilicone concentration of 2% by weight of the mixture, while Sample IB remained transparent at the aminosilicone concentration of 44%. Samples IC and ID were opaque and phase separation was observed indicating that the mixtures of these samples were incompatible.

This example demonstrates that hexanoic acid, which is a Bronsted acid within the scope of the invention, compatibilizes the aminosilicone with mineral oil in the fabric softening mixtures. The compatibilizing effect was not observed in the absence of hexanoic acid. Hydrochloric acid and acetic acid, which are not Bronsted acids within the scope of the present invention, did not have a compatibilizing effect in mixtures of mineral oil with aminosilicone.

EXAMPLE II

Compatibilizing effect of stearic acid in fabric softening mixtures containing an aminosilicone and quaternary ammonium salt was studied. The amount of stearic acid necessary to compatibilize an aminosilicone with a fabric softening agent was approximated using an amine neutral equivalent.

The results that were obtained are summarized in Table I.

TABLE I

| Components | Weight (grams) Sample 1 | 2 | 3 | 4 |
|---|---|---|---|---|
| Aminosilicone | 0.2 | 2.5 | 0.1 | 2.5 |
| Adogen 343[1] | 10 | 10 | — | — |
| Varisoft 137[2] | — | — | 10 | 10 |
| Stearic acid | — | 0.89 | — | 0.89 |

[1]Adogen 343 = dihydrogenated tallow methyl amine from Sherex Corp.
[2]Varisoft 137 = dihydrogenated tallow dimethyl ammonium methylsulfate from Sherex Corp.

Observations:

Samples 1 and 3 were incompatible as determined by the Compatibility Test at aminosilicone concentration of 2% and 1% respectively. Samples 2 and 4 were compatible as determined by the Compatibility Test at 25% silicone concentration.

This example demonstrates that stearic acid, a Bronsted acid within the scope of the invention, compatibilizes aminosilicones with fabric softening agents as determined by the Compatibility Test.

EXAMPLE III

The ability of Bronsted acids to compatibilize amine-functional silicones with mineral oil was investigated.

Example IIIA 10 g of mineral oil (Fischer Heavy Mineral Oil) was placed in a vial. 3 g of an aminosilicone (Silicone SL) was added with stirring. The resulting mixture was an opaque emulsion which completely separated on standing in an oven at 80° C. for 1 hour.

Example IIIB

A series of vials were prepared all containing 10 g mineral oil +3 g Silicone SL and increasing amounts of stearic acid (Sherex Hydrofol Acid 1895). When the amount of acid was 1.5 g or higher and the temperature was above the melting point of the acid, a clear, stable solution formed which did not separate into different phases on standing at elevated temperatures. Upon cooling to room temperature, the compatibilized mixtures remained single phase. Varying the order of addition of the components did not change the outcome of the experiments.

Based an amine neutral equivalent calculation, the amount of stearic acid necessary to compatibilize 3 g of DC X2-8122 is 1.1 g.

Example IIIC 10 g of a fabric softener which is a mixture of dihydrogenated tallow-di-methyl ammonium methylsulfate (70%) and $C_{14}$–$C_{18}$ fatty acids (30% was place in a small vial and melted with stirring. Silicone SL (an aminosilicone) was added to produce a mixture which is 25% silicone by weight (3.33 g of silicone). The resulting mixture was opaque but stable as determined by the Compatibility Test.

Based on amine neutral equivalent calculation, the amount of stearic acid necessary to compatibilize 3.3 g of DC X2-8122 is 1.2g. However, the fabric softener already contained 3 g of fatty acids. Thus, it was not necessary to admix additional Bronsted acid to attain the compatible mixture of Example IIIC.

This example demonstrates that stearic acid, a Bronsted acid within the scope of the invention, compatibilized an aminosilicone with a fabric softener (Example IIIB). Aminosilicone was not compatible with a fabric softener in the absence of a Bronsted acid (Example IIIA).

The example further demonstrates that the amount of Bronsted acid necessary to compatibilize an aminosilicone with a fabric softening component must be ascertained using the Compatibility Test and the amount based on amine neutral equivalent calculation can be used only as a guideline.

EXAMPLE IV

The ability of Bronsted acids to compatibilize aminosilicones with nonionic fabric softeners was investigated.

8 g of Span 60 (a mixture of sorbitan monostearate and isosorbide esters with about 3% fatty acid) was placed in each of several vials. To the vials was aded 3 g of Silicone SL and increasing amounts of stearic acid (Sherex Hydrofol Acid 1895). When the amount of acid exceeded 0.5 g, the mixture formed a clear, stable solution.

Based on amine neutral equivalent calculation, the amount of stearic acid necessary to compatibilize 3g of DC X2-8122 is 1.1 g.

This example demonstrates that an aminosilicone is compatibilized with a nonionic fabric softener by addition of stearic acid.

The example further demonstrates that the amount of Bronsted acid necessary to compatibilize an aminosilicone with a fabric softening component must be ascertained using the compatibility test and the amount based on amine neutral equivalent calculation can be used only as a guideline. Thus, when a fabric softening component contains fatty acid, the amount of Bronsted acid necessary to compatibilize silicone is typically less than the amount based on amine neutral equivalent calculation.

EXAMPLE V

Compatibilizing effect of alkylbenzene sulfonic acid in fabric softening mixtures containing an aminosilicone and nonionic fabric softener was studied.

10 g mineral oil was combined with 3 g Silicone SL and 2 g of a linear alkylbenzene sulfonic acid having 11 carbon alkyl chain. The mixture was stirred at room temperature and formed a clear, stable mixture which did not separate on standing.

This example demonstrates that an aminosilicone is compatibilized with a nonionic fabric softener by addition of alkylbenzene sulfonic acid.

EXAMPLE VI

Compatible fabric conditioning mixtures were prepared. Di(hydrogenated tallow)-di-methyl ammonium methyl sulfate (Varisoft 137 from Sherex Corp.) was combined with commercially available aminosilicones and other softeners in various proportions as indicated in Table II.

The mixtures were all found to be homogeneous and stable at processing and use temperatures.

TABLE II

| | Weight percent of formulation | | | | |
|---|---|---|---|---|---|
| Code | Varisoft 137 | Stearic Acid | Silicone SL | Magnosoft Ultra | Span 60 |
| A | 70 | 10 | — | 20 | — |
| B | 70 | 10 | 2 | — | — |
| C | 23 | 7 | 20 | — | 50 |
| D | 70 | 20 | — | 10 | — |
| E | 70 | 20 | 10 | — | — |

Formulation E from Table II above was fabricated into an article for use in the tumble dryer by coating the molten composition onto sheets of spun bonded polyester using a two roll coating machine.

The article with the solidified softening composition was placed in a tumble dryer with freshly laundered clothing and the dryer was operated in the normal fashion for one hour. Upon removal, the clothing was judged to have excellent antistatic properties. The weight loss of the softening article was assessed and it was judged that the softening composition transferred to the clothing in the environment of the dryer. A 20 member employee panel then judged the clothing to have superior softness when compared to control samples without softener in a pair comparison test.

This invention has been described with respect to certain preferred embodiments and various modifications thereof will occur to persons skilled in the art in the light of the instant specification and are to be included within the spirit and purview of this application and the scope of the appended claims.

What is claimed is:

1. An article for conditioning fabrics which provides for release of a fabric conditioning composition within an automatic laundry dryer at dryer operating temperatures comprising a flexible substrate and an amount effective to condition fabrics of a fabric conditioning composition, carried on said substrate, said composition consisting essentially of:

a) from about 0.1% to about 95% of a fabric softening component selected from:

i) cationic quaternary ammonium salts;

ii) nonionic fabric softens selected from the group consisting of tertiary amines having at least one $C_{8-30}$ alkyl chain, esters of polyhydric alcohols, fatty alcohols, ethoxylated fatty alcohols, alkyl phenols, ethoxylated alkyl phenols, ethoxylated monoglycerides, ethoxylated diglycerides, ethoxylated fatty amines, mineral oils, polyols, and mixtures thereof;

iii) mixtures thereof;

b) about 0.1% about 20% of an amine functional organosilicone; and c) a Bronsted acid having from 6 to 24 carbon atoms;

wherein the weight ratio of c:(a+b) is from about 1:100 to about 100:1 and is at least such that a mutually compatible mixture consisting of said fabric softening component, said aminosilicone and said Bronstead acid is formed as determined by Compatibility Test, wherein said fabric softening composition is applied to the substrate in a molten form.

2. The article of claim 1 wherein an amount of said amine functional organosilicone is about 3% to about 20% by weight of said composition.

3. The article of claim 1 wherein the structure of said amine functional organosilicone is

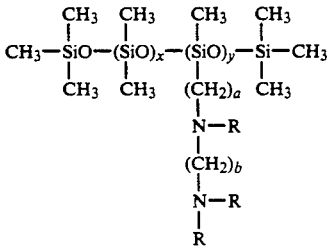

wherein x and y are numbers of at least 1; a and b are numbers from 1 to 10; and R is hydrogen or a hydrocarbon radical.

4. The article of claim 1 wherein said Bronsted acid contains an acid group selected from the group consisting of carboxylic, sulfuric, sulfonic, di-alkyl-sulfosuccinic, phosphonic, phosphinic and phosphoric acids and mixtures thereof.

5. The article of claim 1 wherein said Bronsted acid is stearic acid.

6. The article of claim 1 wherein said cationic quaternary ammonium salt is selected from the group consisting of acyclic quaternary ammonium salts having at least two $C_{8-30}$ alkyl chains, quaternary imidazolinium salts, diamido quaternary ammonium salts, biodegradable quaternary ammonium salts and mixtures thereof.

7. The article of claim 1 wherein said cationic quaternary ammonium salt is selected from the group consisting of ditallowdimethyl ammonium chloride and ditallowimidazolinium chloride.

8. The article of claim 1 wherein said nonionic softener is a fatty tertiary amine having two $C_{8-30}$ alkyl chains.

9. The article of claim 7 wherein said fatty tertiary amine is selected from the group consisting of ditallowmethylamine and ditallowimidazoline.

10. The article of claim 1 wherein said nonionic softener is selected from the group consisting of glycerol stearate and a sorbitan ester.

11. The article of claim 1 wherein said flexible substrate is in a sheet configuration.

12. A method of conditioning laundry in a dryer comprising contacting said laundry with the fabric conditioning article of claim 1.

* * * * *